US009134685B1

(12) United States Patent
Katakura

(10) Patent No.: US 9,134,685 B1
(45) Date of Patent: Sep. 15, 2015

(54) IMAGE FORMING APPARATUS AND IMAGE FORMING METHOD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Hiroshi Katakura, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/536,883

(22) Filed: Nov. 10, 2014

(51) Int. Cl.
*G03G 21/00* (2006.01)
*G03G 15/16* (2006.01)
*G03G 21/10* (2006.01)

(52) U.S. Cl.
CPC ..... *G03G 21/10* (2013.01); *G03G 21/105* (2013.01); *G03G 2215/0193* (2013.01)

(58) Field of Classification Search
CPC ..... G03G 21/10; G03G 21/105; G03G 221/1621; G03G 221/1624; G03G 2215/0193
USPC ..... 399/359, 358, 360, 66
See application file for complete search history.

(56) References Cited

U.S. PATENT DOCUMENTS 7,885,589 B2 2/2011 Fukuyama et al.
2010/0061752 A1* 3/2010 Sudo et al. ..... 399/66

FOREIGN PATENT DOCUMENTS

JP 2003162125 A * 6/2003 ..... G03G 15/01

* cited by examiner

*Primary Examiner* — Billy Lactaoen
(74) *Attorney, Agent, or Firm* — Amin, Turocy & Watson, LLP

(57) ABSTRACT

In accordance with one embodiment, an image forming apparatus comprises a plurality of image forming sections including e a cleaner section for removing the toner left on the image carrier after the image is transferred to the image formed medium. At least one of the plurality of image forming sections is provided with a toner recycling section for collecting the toner removed by the cleaner section and reusing the collected toner in the image formation again. Control section separates the image forming section provided with the toner recycling section from the transfer position of the transfer section in a case in which the image forming section provided with no toner recycling section is forming an image.

10 Claims, 8 Drawing Sheets

IMAGE FORMING APPARATUS AND IMAGE FORMING METHOD

FIELD

Embodiments described herein relate generally to an image forming apparatus and an image forming method.

BACKGROUND

Conventionally, in an electrophotographic type toner image forming apparatus, it is widely applied that an image forming section collects toner left on an image carrier after an image on the image carrier is transferred to an intermediate transfer body, and feeds the collected toner to a developing device again to reuse the toner. In a case of using such an image forming apparatus, a user can save the consumption of the toner.

Particularly, in recent years, a kind of toner obtained by adding value to highly decorative toner in which special pigment is used or decolorable toner is used as the toner. Such a kind of toner with high added value is more expensive than normal toner. Thus, the user can obtain significant cost benefits if the toner with high added value can be recycled.

However, in an image forming apparatus provided with a plurality of image forming sections that use both the toner with high added value and the normal toner, the normal toner may be mixed with the toner with high added value when collecting the toner with high added value. In this case, the toner cannot be reused efficiently.

DETAILED DESCRIPTION

In accordance with one embodiment, an image forming apparatus comprises a plurality of image forming sections, a transfer section and a control section. The plurality of image forming sections form an image on an image carrier with toner. The transfer section transfers the image formed on the image carrier to an image formed medium. The control section controls the relative position of the image forming section and the transfer section. The plurality of image forming sections include a cleaner section for removing the toner left on the image carrier after the image is transferred to the image formed medium. At least one of the plurality of image forming sections is provided with a toner recycling section for collecting the toner removed by the cleaner section and reusing the collected toner in the image formation again. The control section separates the image forming section provided with the toner recycling section from the transfer position of the transfer section in a case in which the image forming section provided with no toner recycling section is forming an image.

Hereinafter, the image forming apparatus and the image forming method according to the embodiment are described with reference to the accompanying drawings.

A First Embodiment

Figure 1:
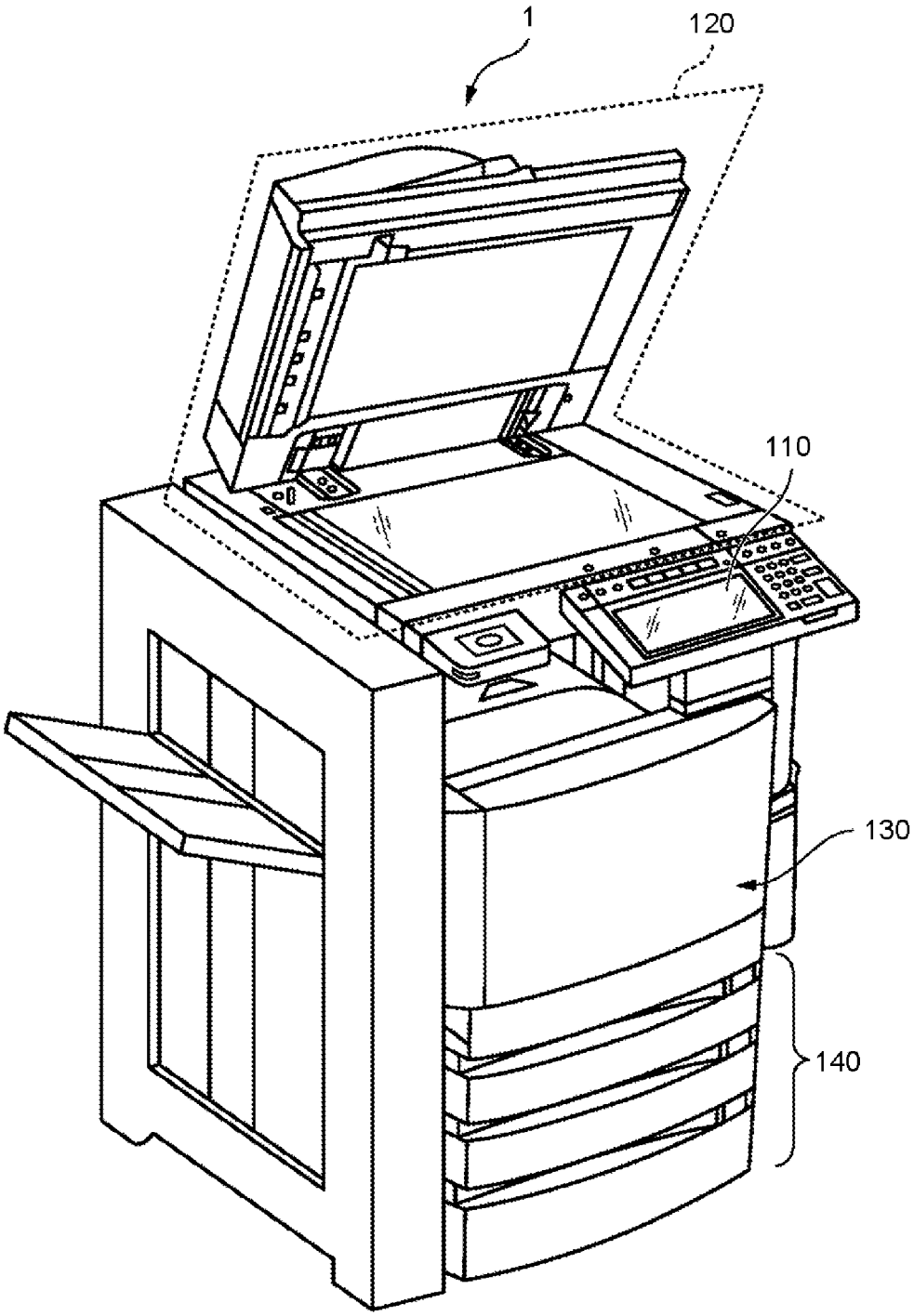
FIG. 1 is an external view illustrating one example of an image forming apparatus 1 according to a first embodiment.

Hereinafter, an image forming apparatus 1 according to the first embodiment is described. FIG. 1 is an external view illustrating one example of an image forming apparatus 1 according to the first embodiment. For example, the image forming apparatus 1 is a multi function peripheral (MFP). The image forming apparatus 1 reads an image formed on a sheet-like image formed medium (hereinafter referred to as a "sheet") such as paper and the like to generate digital data (image file). The image forming apparatus 1 forms an image on the sheet with toner based on the digital data.

The image forming apparatus 1 includes a display section 110, an image reading section 120, an image forming section 130 and a sheet tray 140.

The display section 110 operates as an output interface to display characters and images. The display section 110 also operates as an input interface to receive an instruction from a user. The display section 110 is, for example, a liquid crystal display provided with a touch panel.

The image reading section 120 is, for example, a color scanner provided with a contact image sensor (CIS), a charge coupled devices (CCD) and the like. The image reading section 120 reads, with a sensor, the image formed on the sheet to generate the digital data.

The image forming section 130 forms an image on the sheet with the toner. The image forming section 130 forms an image based on the image data read by the image reading section 120 or the image data received from an external machine. The image formed on the sheet is an output image referred to as, for example, hard copy, printout and the like.

The sheet tray 140 supplies a sheet of any size to the image forming section 130 to be used in the image output.

Figure 2:
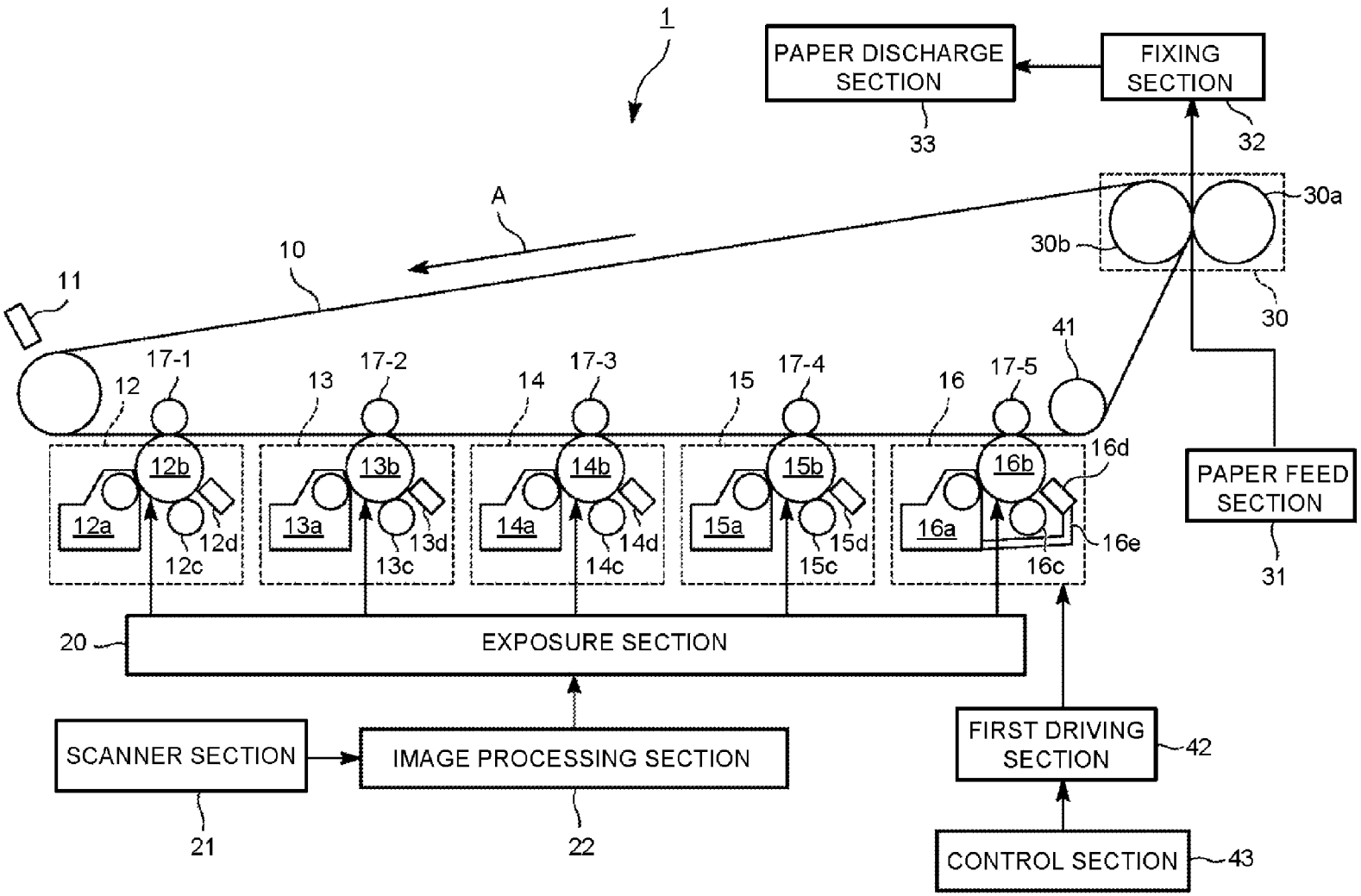
FIG. 2 is a diagram illustrating an example of the schematic constitution of the image forming apparatus 1 according to the first embodiment.

FIG. 2 is a diagram illustrating an example of the schematic constitution of the image forming apparatus 1 according to the first embodiment. The image forming apparatus 1 is an electrophotographic type image forming apparatus. The image forming apparatus 1 is a five tandem image forming apparatus. As the specific examples of the toner, decolorable toner, non-decolorable toner (normal toner), decorative toner and the like can be listed. The decolorable toner has such a characteristic that the color thereof is decolored through external stimuli. The "decoloring" mentioned herein refers to making the image, which is formed in a color (including not only chromatic color but also achromatic color such as white color, black color and the like) different from the ground color of the sheet, invisible. The external stimuli include, for example, temperature, light having a specific wavelength, pressure and the like. As specific examples of the decorative toner, toner containing perfume, toner containing special pigment and the like are considered. The special pigment includes toner containing pearl pigment, metallic pigment and the like.

The image forming apparatus 1 includes an intermediate transfer body 10, a cleaning blade 11, image forming sections 12~16, primary transfer rollers 17-1~17-5, an exposure section 20, a scanner section 21, an image processing section 22, a secondary transfer section 30, a paper feed section 31, a fixing section 32, a paper discharge section 33, a support roller 41, a first driving section 42 and a control section 43. In the following description, the primary transfer rollers 17-1~17-5 is simply referred to as a primary transfer roller 17 in a case of not desiring to distinguish the primary transfer rollers.

The transfer process in the image forming apparatus 1 includes a first transfer process and a second transfer process. In the first transfer process, the primary transfer roller 17 transfers the image formed on a photoconductive drum of each image forming section with toner to the intermediate transfer body 10. In the second transfer process, secondary transfer section 30 collectively transfers the images, which are formed with the toner of each color and are laminated on the intermediate transfer body 10, to the sheet.

The intermediate transfer body 10, which is an endless belt, rotates in a direction indicated by an arrow A shown in FIG. 2.

The cleaning blade 11 removes the toner adhering on the intermediate transfer body 10. The cleaning blade 11 is, for example, a plate-shaped member. The cleaning blade 11 is formed by, for example, rubber such as urethane resin and the like.

Each of the image forming sections 12~16 forms an image with the toner of each color (five colors in the example shown in FIG. 2). The image forming sections 12~16 are arranged side by side in sequence along the intermediate transfer body 10 from the upstream side of the rotation direction of the intermediate transfer body 10.

The primary transfer roller 17 (17-1~17-5) transfers the images formed by each of the image forming sections 12~16 with the toner to the intermediate transfer body 10.

The exposure section 20 irradiates (exposes) the photoconductive drum of the image forming section with light. The exposure section 20 includes an exposure light source such as laser, LED and the like.

The scanner section 21 reads the image formed on the sheet and outputs the read image to the image processing section 22 as the image data. The scanner section 21 reads the image formed on the sheet to generate, for example, the image data of three primary colors of red (R), green (G) and blue (B).

The image processing section 22 converts the image data into a color signal of each color. The image processing section 22 converts the image data into, for example, image data (color signals) of four colors of yellow (Y), magenta (M), cyan (C) and black (K). The image processing section 22 controls the exposure section 20 based on the color signal of each color.

The secondary transfer section 30 is described as a specific example of the secondary transfer body. The secondary transfer section 30 collectively transfers the images formed on the intermediate transfer body 10 with the toner to the sheet. The secondary transfer section 30 includes a secondary transfer roller 30*a* and a secondary transfer opposing roller 30*b*.

The paper feed section 31 feeds a sheet.

The fixing section 32 heats and presses the image formed with the toner and transferred to the sheet to fix the image on the sheet.

The support roller 41 supports the intermediate transfer body 10.

The first driving section 42 changes the position of the image forming section 16.

The control section 43 controls the relative position of the intermediate transfer body 10 and the image forming section 16. That is, the relative position relation between the primary transfer position and the image forming section 16 is changed. The control section 43 drives the first driving section 42 to control the position of the image forming section 16.

Next, the image forming sections 12~16 are described. In the example shown in FIG. 2, only the image forming section 16 is provided with a toner recycling mechanism 16*e*. In the example shown in FIG. 2, the image forming sections 12~15 respectively store the toner of each color corresponding to the four colors for color printing. The four colors for color printing include yellow (Y), magenta (M), cyan (C) and black (K) colors. The image forming section 16 stores the toner that a user desires to reuse. For example, the image forming section 16 stores toner such as the decorative toner, the decolorable toner and the like. Each of the image forming sections 12~16 may be detached from the image forming apparatus 1. Herein, though it is exemplified that the decolorable toner is used as the toner having an added value, the present invention is not limited to this.

The decolorable toner used in the present embodiment is manufactured in the following way.

First, the preparation of atomized solution containing binder resin is described. Pes (Polyester) resin with a glass transition temperature Tg of 50 degrees centigrade and a softening point of 100 degrees centigrade is used as the binder resin. The particle dispersion (atomized solution) containing binder resin is manufactured with a high-pressure homogenizer using 30 pts. mass of Pes resin, 3 pts. mass of anionic emulsifier (NEOPELEX G15, manufactured by Kao Corp.), 0.6 pts. mass of neutralizing agent (dimethylaminoethanol).

Next, the preparation of release agent atomized solution is described. The release agent atomized solution is manufactured using 30 pts. mass of rice WAX using the same manufacturing method of the binder resin.

Next, the preparation of coloring agent is described. The coloring agent is manufactured by heating and dissolving the component including 1 pts. mass of 3-(2-ethoxy-4-diethylaminophenyl)-3-(1-ethyl-2-methylindole-3-yl)-4-azaphthalide as the leuko dye; 5 pts. mass of 2,2-Bis(4-hydroxyphenyl) hexafluoropropane as color developing agent; and 50 pts. mass of diester compound of pimelic acid and 2-(4-benzyloxy-phenyl) ethanol as decoloring agent (temperature control agent); adding the mixture solution of 20 pts. mass of aromatic polyvalent Isocyanate prepolymer as encapsulating agent and 40 pts. mass of ethyl acetate to 250 pts. mass of 8% polyvinyl alcohol solution; and then emulsifying and dispersing the mixture solution. Sequentially, after stirring for an hour at a temperature of 70 degrees centigrade, adding 2 pts. mass of water-soluble aliphatic modified amine as reactant, and then stirring the solution for about three hours while maintaining the solution at 90 degrees centigrade to obtain leuco capsule particle. Then, putting the capsule particle dispersion in a freezer (−30 degrees centigrade) to generate color, thereby obtaining blue coloring agent. The volume average particle diameter of the color generation particle C1 is 2 μm when measured by SALD7000 manufactured by Shimadzu Corporation.

The process of aggregation and fusion: aggregating 10 pts. mass of encapsulated coloring agent, 283 pts. mass of atomized solution containing binder resin, and 17 pts. mass of release agent atomized solution using 100 pts. mass of aluminum sulfate [Al2(SO4)3] 5% solution at 45 degrees centigrade. Then, raising the temperature up to 65 degrees centigrade (temperature rising speed: 1 degree centigrade/min) and fusing, then rinsing and drying to obtain capsule color decolorable toner. The amount of the coloring agent in the capsule color decolorable toner is 10 mass %.

The complete decoloring temperature of the toner is 107 degrees centigrade, and the decoloring starting temperature is degrees centigrade, and further, the complete color generating temperature is −5 degrees centigrade.

First, the schematic constitution of the image forming section 12 is described.

The image forming section 12 includes a developing device 12*a*, a photoconductive drum 12*b*, a charger 12*c* and a cleaning blade 12*d*.

The developing device 12*a* adheres toner to the photoconductive drum 12*b*. The developing device 12*a* stores developing agent. The developing agent contains the toner.

The photoconductive drum 12*b* is described as a specific example of the image carrier (image carrying module). The photoconductive drum 12*b* is provided with a photoconductor (photoconductive area) on the outer peripheral surface thereof. The photoconductor is, for example, an organic photo conductor (OPC).

The charger 12*c* uniformly charges the surface of the photoconductive drum 12*b*.

The cleaning blade 12*d* removes the toner adhering to the photoconductive drum 12*b*. The cleaning blade 12*d* is, for example, a plate-shaped member. The cleaning blade 12*d* is formed by rubber such as urethane resin and the like.

Next, the schematic operation of the image forming section 12 is described.

The photoconductive drum 12*b* is charged by the charger 12*c* to a given potential. Then, the light from the exposure section 20 is radiated to the photoconductive drum 12*b*. In this way, the potential of the area on the photoconductive drum 12*b* where the light is radiated is changed. Thus, an electrostatic latent image is formed on the surface of the photoconductive drum 12*b*. The electrostatic latent image on the surface of the photoconductive drum 12*b* is developed with the developing agent of the developing device 12*a*. That is, an image (hereinafter referred to as a "developed image") is formed on the surface of the photoconductive drum 12*b* with toner.

The developed image formed on the surface of the photoconductive drum 12*b* is transferred (first transfer process) to the intermediate transfer body 10 by the primary transfer roller 17-1 arranged opposite to the photoconductive drum 12*b*. At this time, part of the toner contained in the developed image is left on the photoconductive drum 12*b* without being transferred to the intermediate transfer body 10.

The cleaning blade 12*d* removes the toner left on the photoconductive drum 12*b* from the photoconductive drum 12*b*.

The constitutions and the operations of the image forming sections 13~15 are the same as the constitution and the operation of the image forming section 12 except that the developing agent stored therein is different, thus, the descriptions thereof is omitted.

The constitution and the operation of the image forming section 16 are the same as the constitution and the operation of the image forming section 12 except for the following points. That is, the developing agent stored in the image forming section 16 is different from that stored in the image forming section 12, the image forming section 16 is provided with the toner recycling mechanism 16*e*, and the position of the image forming section 16 is changed by the first driving section 42.

Next, the first transfer process in the image forming apparatus 1 is described. In the example shown in FIG. 2, first, the primary transfer roller 17-1 opposite to the photoconductive drum 12*b* transfers the developed image on the photoconductive drum 12*b* to the intermediate transfer body 10. The primary transfer roller 17-2 opposite to the photoconductive drum 13*b* transfers the developed image on the photoconductive drum 13*b* to the intermediate transfer body 10. The primary transfer roller 17-3 opposite to the photoconductive drum 14*b* transfers the developed image on the photoconductive drum 14*b* to the intermediate transfer body 10. The primary transfer roller 17-4 opposite to the photoconductive drum 15*b* transfers the developed image on the photoconductive drum 15*b* to the intermediate transfer body 10. Then the primary transfer roller 17-5 opposite to the photoconductive drum 16*b* transfers the developed image on the photoconductive drum 16*b* to the intermediate transfer body 10. At this time, the developed image on each of the photoconductive drums 12*b*-16*b* is transferred to the intermediate transfer body 10 in an overlapped manner. Thus, the developed images based on the toner of each color are superimposed and transferred to the intermediate transfer body 10 that passes through the image forming section 16.

Next, the second transfer process is described. The secondary transfer section 30 collectively transfers the developed images that are formed with the toner of each color and are superimposed on the intermediate transfer body 10 to the sheet. In the example shown in FIG. 2, the voltage (bias) is applied to the secondary transfer opposing roller 30*b* to generate an electric field between the secondary transfer opposing roller 30*b* and the secondary transfer roller 30*a*. The secondary transfer section 30 transfers the developed image formed on the intermediate transfer body 10 to the sheet through the electric field between the secondary transfer opposing roller 30*b* and the secondary transfer roller 30*a*. The developed image (unfixed toner image) secondarily transferred to the sheet is heated and pressed by the fixing section 32 to be fixed on the sheet.

The sheet is fed from the paper feed section 31 and conveyed through a paper conveyance path. The sheet is passed through the secondary transfer section 30 and the fixing section 32 and then conveyed to the paper discharge section 33.

Figure 3:
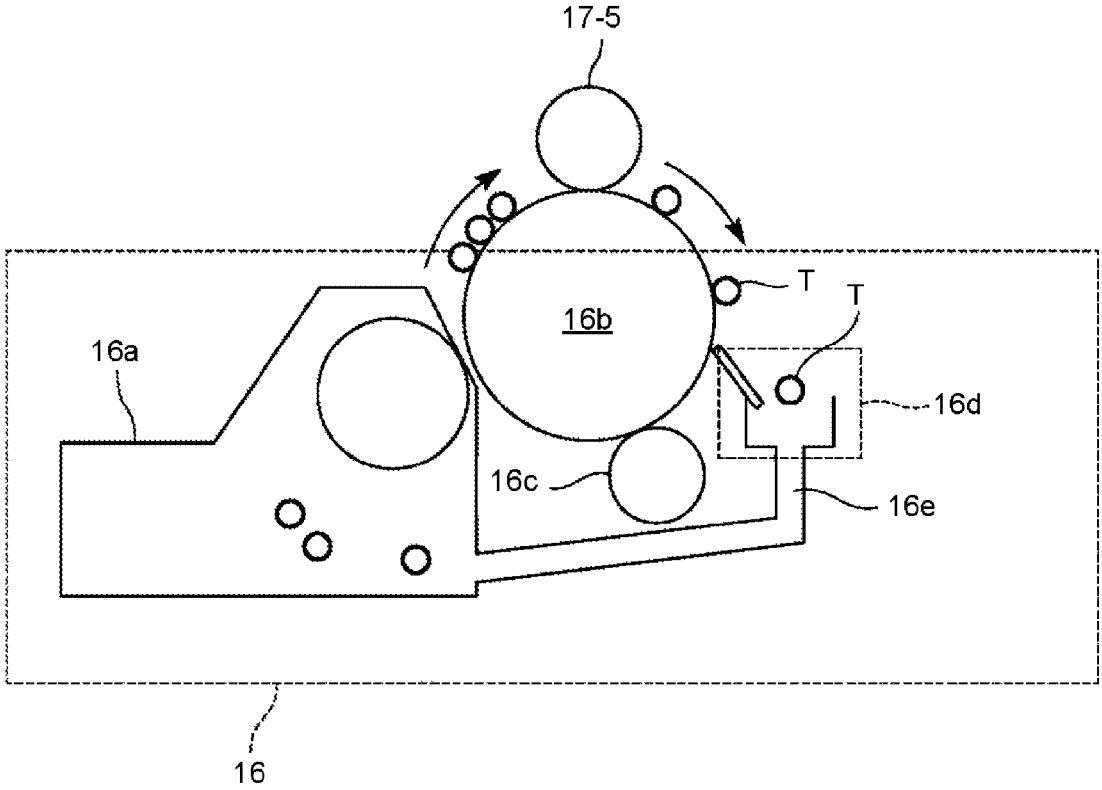
FIG. 3 is a diagram illustrating an example of the schematic constitution and the operation of an image forming section 16 of the image forming apparatus 1.

FIG. 3 is a diagram illustrating an example of the schematic constitution and the operation of the image forming section 16 of the image forming apparatus 1.

First, the schematic constitution of the image forming section 16 is described. The image forming section 16 includes the developing device 16*a*, the photoconductive drum 16*b*, the charger 16*c*, the cleaning blade 16*d* and the toner recycling mechanism 16*e*. The cleaning blade 16*d* is described as a specific example of the cleaner section. The toner recycling mechanism 16*e* is described as a specific example of the toner recycling section.

The developing device 16*a* adheres toner to the photoconductive drum 16*b*. The developing device 16*a* stores the developing agent. The developing agent contains the toner.

The photoconductive drum 16*b* is described as a specific example of the image carrier. The photoconductive drum 16*b* is provided with a photoconductor on the outer peripheral surface thereof. The photoconductor is, for example, an organic photo conductor (OPC). In the example shown in FIG. 3, the photoconductive drum 16*b* is rotated in a direction indicated by an arrow shown in FIG. 3.

The charger 16*c* uniformly charges the surface of the photoconductive drum 16*b*.

The cleaning blade 16*d* removes the toner adhering to the photoconductive drum 16*b*. The cleaning blade 16*d* is, for example, a plate-shaped member. The cleaning blade 16*d* is formed by rubber such as urethane resin and the like.

The toner recycling mechanism 16*e* feeds the toner removed from the photoconductive drum 16*b* by the cleaning blade 16*d* to the developing device 16*a*.

Next, the schematic operation of the image forming section 16 is described. The photoconductive drum 16*b* is charged by the charger 16*c* to a given potential. Then, the light from the exposure section 20 is radiated to the photoconductive drum 16*b*. In this way, the potential of the area on the photoconductive drum 16*b* where the light is radiated is changed. Thus, an electrostatic latent image is formed on the surface of the photoconductive drum 16*b*. The electrostatic latent image on the surface of the photoconductive drum 16*b* is developed with the developing agent of the developing device 16*a*. That is, a developed image is formed on the surface of the photoconductive drum 16*b*.

The reference numeral "T" shown in FIG. 3 indicates the toner. The toner T is stored in the developing device 16*a*. The developing device 16*a* adheres the toner T to the electrostatic latent image formed on the surface of the photoconductive drum 16*b* to form the developed image. The developed image on the photoconductive drum 16*b* is transferred to the intermediate transfer body 10 by the primary transfer roller 17-5 opposite to the photoconductive drum 16*b*. At this time, part of the toner contained in the developed image is left on the photoconductive drum 16*b* without being transferred to the intermediate transfer body 10.

The toner (hereinafter referred to as "residual toner") left on the photoconductive drum 16*b* without being transferred to the intermediate transfer body 10 is removed by the cleaning blade 16*d*. The residual toner removed by the cleaning blade 16*d* is fed to the developing device 16*a* through the toner recycling mechanism 16*e*. The developing device 16*a* reuses the residual toner. The toner recycling mechanism 16*e* is provided with a toner conveyance path constituted by, for example, a hollow pipe. The residual toner drops through the toner conveyance path of the toner recycling mechanism 16*e* due to the gravity, and is guided to the developing device 16*a*. The image forming apparatus 1 may also use a conveyance pump to guide the residual toner from the toner recycling mechanism 16*e* to the developing device 16*a*. The conveyance pump is a pump for conveying powder through air flow.

Figure 4:
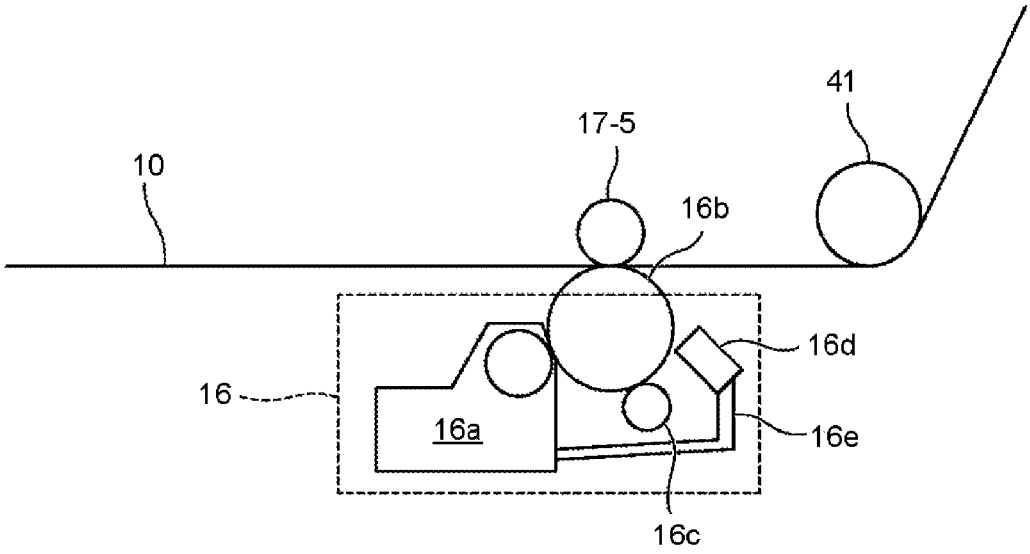
FIG. 4 is a diagram illustrating an example of the operation of the image forming apparatus 1.

FIG. 4 is a diagram illustrating an example of the operation of the image forming apparatus 1. In a case in which the image forming section 16 provided with the toner recycling mechanism 16*e* forms an image, the control section 43 contacts the image forming section 16 with the intermediate transfer body 10. That is, the image forming section 16 is brought into contact with the intermediate transfer body 10. At this time, the primary transfer roller 17-5 faces the photoconductive drum 16*b* across the intermediate transfer body 10. When the image forming section 16 is forming an image, the image forming sections 12~15 do not form an image.

Figure 5:
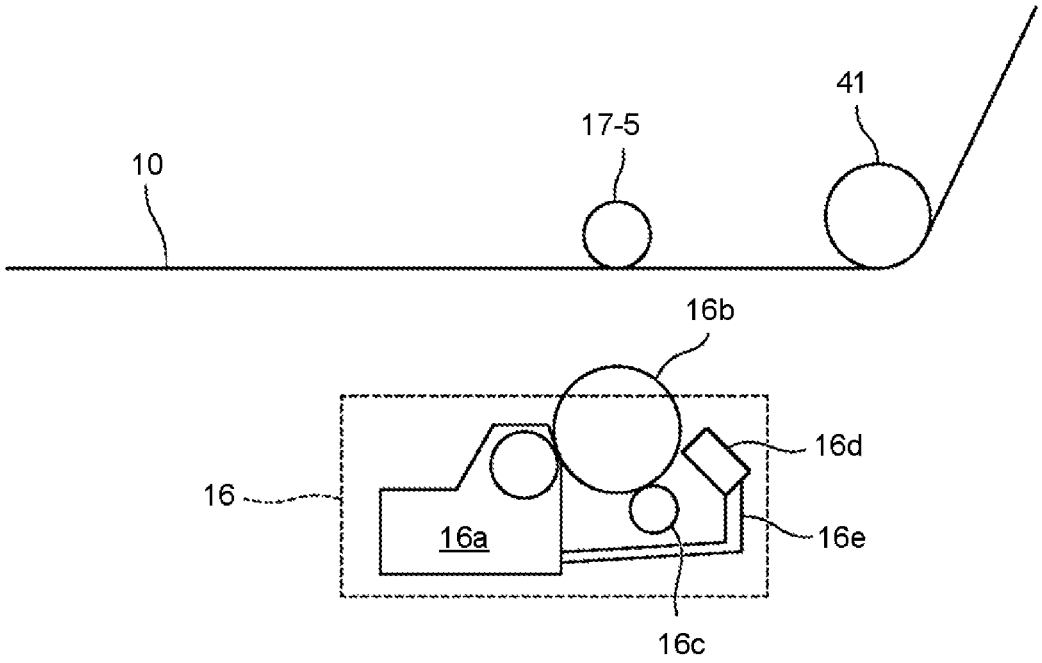
FIG. 5 is a diagram illustrating an example of the operation of the image forming apparatus 1.

FIG. 5 is a diagram illustrating an example of the operation of the image forming apparatus 1. In the image forming apparatus 1, the image forming section 16 provided with the toner recycling mechanism 16*e* does not form an image when any of the image forming sections 12~15 is forming an image. In other words, when the image forming section 16 provided with the toner recycling mechanism 16*e* is not forming an image, the control section 43 separates the image forming section 16 from the intermediate transfer body 10. In the example shown in FIG. 5, the control section 43 drives the first driving section 42 to move the image forming section 16 downwards in FIG. 5.

In accordance with the first embodiment described above, the image forming apparatus 1 is provided with the cleaning blade 16*d* for removing the residual toner left on the photoconductive drum 16*b*, the toner recycling mechanism 16*e* for collecting and feeding the removed residual toner to the developing device 16*a* and the control section 43 for driving the first driving section 42 to control the position of the image forming section 16, thus, the toner can be reused efficiently.

In a case in which the image forming section 16 provided with the toner recycling mechanism 16*e* forms an image, the image forming apparatus 1 drives the first driving section 42 to contact the image forming section 16 with the intermediate transfer body 10. In this case, the image forming apparatus 1 collects the residual toner left on the photoconductive drum 16*b* and feeds the toner to the developing device 16*a* to reuse the collected residual toner. In this way, the image forming apparatus 1 can reuse the toner efficiently.

Further, in a case in which the image forming section 16 provided with the toner recycling mechanism 16*e* is not forming an image, the image forming apparatus 1 drives the first driving section 42 to separate the image forming section 16 from the intermediate transfer body 10. In this way, it is possible to prevent that the toner contained in the developed image formed by any of the image forming sections 12~15 is reversely transferred and adhered to the photoconductive drum 16*b*. Thus, the image forming apparatus 1 can prevent that the toner in other image forming sections is mixed with the toner collected by the toner recycling mechanism 16*e* and stored in the image forming section 16. That is, the image forming apparatus 1 can reuse the toner efficiently.

Further, the user can suppress the consumption of toner if the toner high in cost is stored in the image forming section 16. Thus, the user can suppress the cost of the printing.

Next, a modification of the image forming apparatus 1 is described.

In the image forming apparatus 1 according to the first embodiment described above, the number of the image forming sections is five, however, the present invention is not limited to this. The number of the image forming sections may be more or less than five.

In a case in which the image forming section 16 is forming an image, the image forming sections 12~15 may be separated from the intermediate transfer body 10 by an independent driving section. In this way, it is possible to prevent that the intermediate transfer body 10 is contacted with the photoconductive drums 12*b*-15*b* and the toner on the photoconductive drums 12*b*-15*b* is adhered to the intermediate transfer body 10. Thus, it is possible to prevent that the toner of the image forming sections 12~15 is reversely transferred to the photoconductive drum 16*b* via the intermediate transfer body 10 and is collected by the toner recycling mechanism 16*e*.

In the secondary transfer section 30, the bias may be applied to the secondary transfer roller 30*a* instead of the secondary transfer opposing roller 30*b*. At this time, a bias having a polarity opposite to that of the voltage applied to the secondary transfer opposing roller 30*b* is applied to the secondary transfer roller 30*a*. The secondary transfer section 30 transfers the developed image formed on the intermediate transfer body 10 to the sheet through the electric field generated between the secondary transfer opposing roller 30*b* and the secondary transfer roller 30*a*.

In the image forming apparatus 1 according to the first embodiment, only the image forming section 16 is arranged as an image forming section provided with the toner recycling mechanism, however, a plurality of image forming sections may be provided with the toner recycling mechanism. The image forming sections provided with the toner recycling mechanism do not form an image and are separated from the intermediate transfer body 10 when other image forming sections are forming an image. The control section 43 drives the first driving section 42 to change the positions of the image forming sections provided with the toner recycling mechanism. When the image forming sections provided with the toner recycling mechanism are forming an image, other image forming sections do not form an image.

A Second Embodiment

Figure 6:
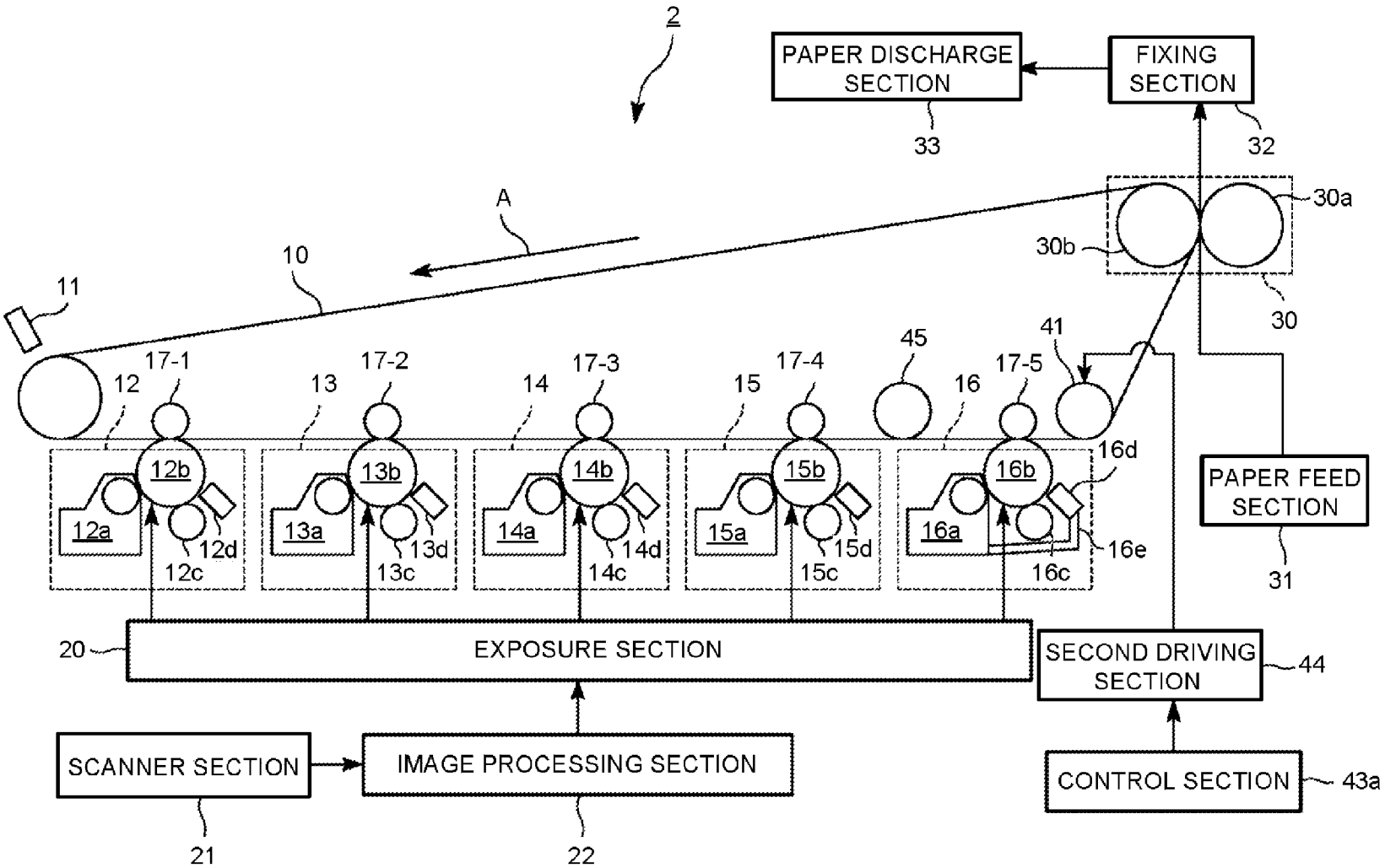
FIG. 6 is a diagram illustrating an example of the schematic constitution of an image forming apparatus 2 according to a second embodiment.

Hereinafter, an image forming apparatus 2 according to the second embodiment is described. FIG. 6 is a diagram illustrating an example of the schematic constitution of the image forming apparatus 2 according to the second embodiment. The constitution of the image forming apparatus 2 according to the second embodiment is the same as that of the image forming apparatus 1 according to the first embodiment except for the following points. That is, the image forming apparatus 2 is provided with a second driving section 44 instead of the first driving section 42 and the image forming apparatus 2 is further provided with a support roller 45. The same components in the image forming apparatus 2 as those shown in the image forming apparatus 1 according to the first embodiment are indicated by the same reference numerals, and the repetitive description is not provided. A control section 43*a* controls the relative position of the intermediate transfer body 10 and the image forming section 16. The control section 43*a* drives the second driving section 44. The second driving section 44 changes the position of the support roller 41. The support roller 45 maintains a proper tension to support the intermediate transfer body 10 even if the position of the support roller 41 is changed.

Figure 7:
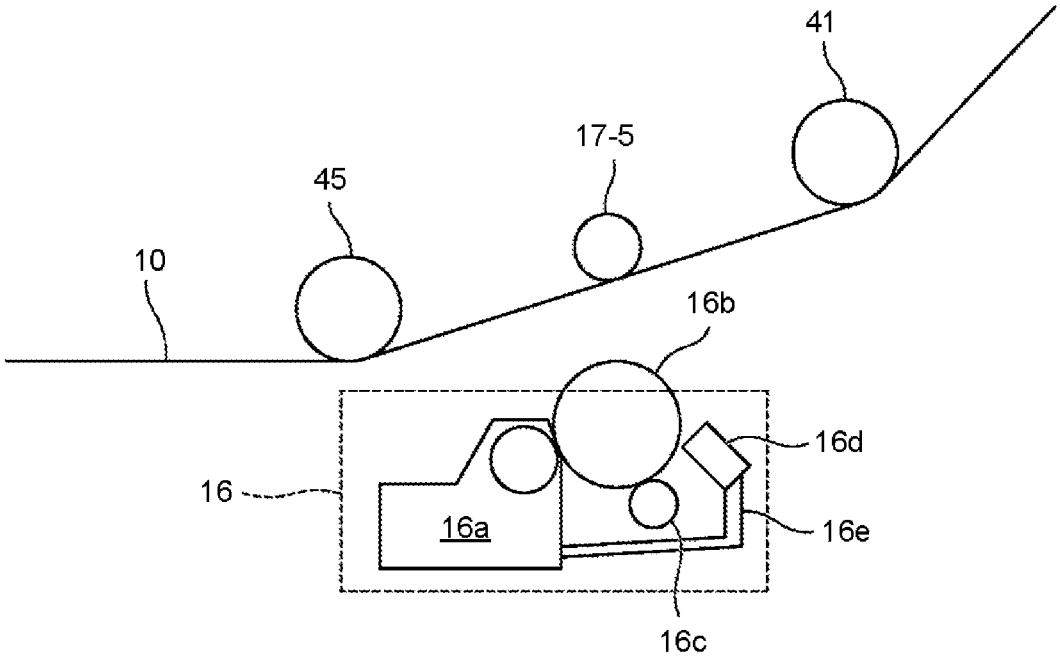
FIG. 7 is a diagram illustrating an example of the operation of the image forming apparatus 2.

FIG. 7 is a diagram illustrating an example of the operation of the image forming apparatus 2. In a case in which the image forming section 16 provided with the toner recycling mechanism 16*e* does not form an image, the control section 43*a* separates the image forming section 16 from the intermediate transfer body 10. In the example shown in FIG. 7, the control section 43*a* drives the second driving section 44 to move the support roller 41 upwards in FIG. 7, and in this way, the intermediate transfer body 10 is separated from the image forming section 16. Further, the control section 43*a* may drive the second driving section 44 to move the primary transfer roller 17-5 arranged opposite to the photoconductive drum 16*b* upwards in FIG. 7.

In accordance with the second embodiment described above, the image forming apparatus 2 is provided with the cleaning blade 16*d* for removing the residual toner left on the photoconductive drum 16*b*, the toner recycling mechanism 16*e* for collecting and feeding the removed residual toner to the developing device 16*a* and the control section 43*a* for driving the second driving section 44 to control the position of the support roller 41, thus, the toner can be reused efficiently.

In a case in which the image forming section 16 forms an image, the image forming apparatus 2 drives the second driving section 44 to control the position of the support roller 41 to contact the intermediate transfer body 10 with the image forming section 16. In this case, the image forming apparatus 2 collects the residual toner left on the photoconductive drum 16*b* and feeds the toner to the developing device 16*a* to reuse the collected residual toner. In this way, the image forming apparatus 2 can reuse the toner efficiently.

Further, in a case in which the image forming section 16 is not forming an image, the image forming apparatus 2 drives the second driving section 44 to control the position of the support roller 41 to separate the intermediate transfer body 10 from the image forming section 16. In this way, it is possible to prevent that the toner contained in the developed image formed by any of the image forming sections 12~15 is reversely transferred and adhered to the photoconductive drum 16*b*. Thus, the image forming apparatus 2 can prevent that the toner in other image forming sections is mixed with the toner collected by the toner recycling mechanism 16*e* and stored in the image forming section 16. That is, the image forming apparatus 2 can reuse the toner efficiently.

Next, a modification of the image forming apparatus 2 is described.

In the image forming apparatus 1 according to the first embodiment described above, the number of the image forming sections is five, however, the present invention is not limited to this. The number of the image forming sections may be more or less than five.

Similar to the image forming apparatus 1, in the image forming apparatus 2, in a case in which the image forming section 16 is forming an image, the image forming sections 12~15 may be separated from the intermediate transfer body 10 by an independent driving section. In this way, it is possible to prevent that the toner on the photoconductive drums 12*b*-15*b* is reversely transferred to the photoconductive drum 16*b* via the intermediate transfer body 10. That is, it is possible to prevent that the toner of the image forming sections 12~15 is collected by the toner recycling mechanism 16*e*.

Similar to the image forming apparatus 1, in the image forming apparatus 2, the bias may be applied to the secondary transfer roller 30*a* instead of the secondary transfer opposing roller 30*b*.

A Third Embodiment

Figure 8:
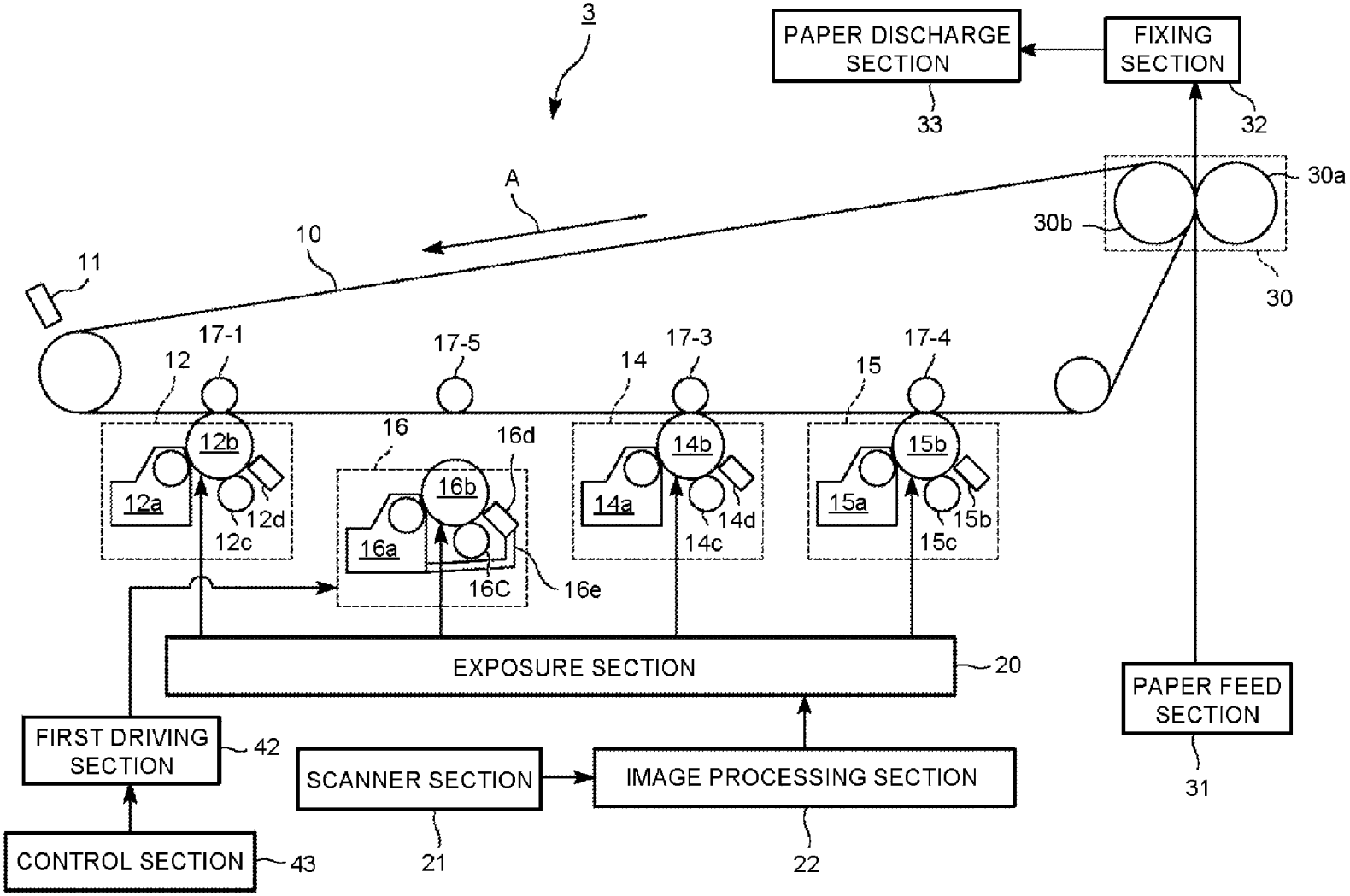
FIG. 8 is a diagram illustrating an example of the schematic constitution and the operation of an image forming apparatus 3 according to a third embodiment.

Hereinafter, an image forming apparatus 3 according to the third embodiment is described. FIG. 8 is a diagram illustrating an example of the schematic constitution and the operation of the image forming apparatus 3 according to the third embodiment. The constitution of the image forming apparatus 3 according to the third embodiment is the same as that of the image forming apparatus 1 according to the first embodiment except for the following points. That is, the image forming apparatus 3 is a quadruple tandem image forming apparatus provided with four image forming sections; the image forming apparatus 3 is provided with no image forming section 13; and in the image forming apparatus 3, the image forming section 16 provided with the toner recycling mechanism 16*e* is arranged between the image forming section 12 and the image forming section 14. The same components in the image forming apparatus 3 as those shown in the image forming apparatus 1 according to the first embodiment are indicated by the same reference numerals, and the repetitive description is not provided.

In the example shown in FIG. 8, in a case in which any of the image forming sections 12, 14 and 15 is forming an image, the image forming section 16 provided with the toner recycling mechanism 16*e* does not form an image. In a case in which the image forming section 16 provided with the toner recycling mechanism 16*e* does not form an image, the control section 43 separates the image forming section 16 from the intermediate transfer body 10. In the example shown in FIG. 8, the control section 43 drives the first driving section 42 to move the image forming section 16 upwards in FIG. 8.

In a case in which the image forming section 16 provided with the toner recycling mechanism 16*e* forms an image, the control section 43 contacts the image forming section 16 with the intermediate transfer body 10. When the image forming section 16 is forming an image, the image forming sections 12, 14 and 15 do not form an image.

Similar to the image forming apparatus 1 according to the first embodiment, the image forming apparatus 3 according to the third embodiment can reuse the toner efficiently.

Next, a modification of the image forming apparatus 3 is described.

In the image forming apparatus 3 according to the third embodiment described above, the number of the image forming sections is four, however, the present invention is not limited to this. The number of the image forming sections may be more or less than four.

In the image forming apparatus 3, in a case in which the image forming section 16 is forming an image, the image forming section 12 may be separated from the intermediate transfer body 10 by an independent driving section. In this way, it is possible to prevent that the toner on the photoconductive drum 12*b* arranged at the upstream side of the image forming section 16 is reversely transferred to the photoconductive drum 16*b* via the intermediate transfer body 10. Thus, it is possible to prevent that the toner of the image forming section 12 is collected by the toner recycling mechanism 16*e*. Thus, the image forming apparatus 3 can reuse the toner efficiently.

Further, in a case in which the image forming section 16 is forming an image, the image forming sections 14 and 15 may be separated from the intermediate transfer body 10 by an independent driving section. In this way, it is possible to prevent that the toner on the photoconductive drum 14*b* or 15*b* is reversely transferred to the photoconductive drum 16*b* via the intermediate transfer body 10. Thus, it is possible to prevent that the toner of the image forming section 14 or 15 is collected by the toner recycling mechanism 16*e*. Thus, the image forming apparatus 3 can reuse the toner efficiently.

Similar to the image forming apparatus 1, in the image forming apparatus 3, the bias may be applied to the secondary transfer roller 30*a* instead of the secondary transfer opposing roller 30*b*.

A Fourth Embodiment

Figure 9:
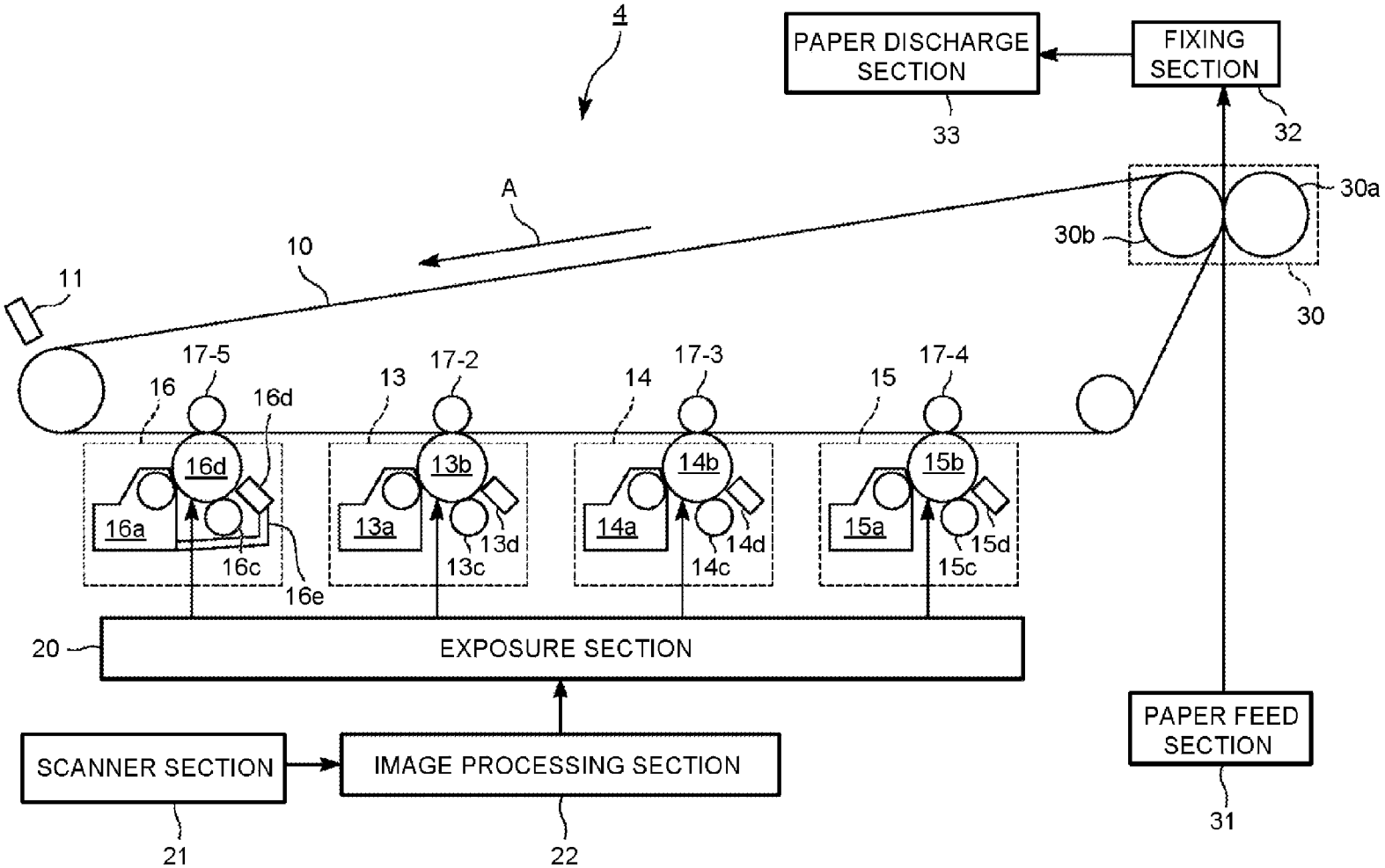
FIG. 9 is a diagram illustrating an example of the schematic constitution and the operation of an image forming apparatus 4 according to a fourth embodiment.

Hereinafter, an image forming apparatus 4 according to the fourth embodiment is described. FIG. 9 is a diagram illustrating an example of the schematic constitution and the operation of the image forming apparatus 4 according to the fourth embodiment. The constitution of the image forming apparatus 4 is the same as that of the image forming apparatus 1 according to the first embodiment except for the following points. That is, the image forming apparatus 4 is a quadruple tandem image forming apparatus provided with four image forming sections; the image forming apparatus 4 is provided with the image forming section 16 including the toner recycling mechanism 16*e* at the most upstream side instead of the image forming section 12; and the image forming apparatus 4 is not provided with the first driving section 42 or the control section 43. The same components in the image forming apparatus 4 as those shown in the image forming apparatus 1 according to the first embodiment are indicated by the same reference numerals, and the repetitive description is not provided.

In the example shown in FIG. 9, the image forming section 16 provided with the toner recycling mechanism 16*e* is positioned at the most upstream side of the plurality of image forming sections arranged along the intermediate transfer body 10. Thus, all the toner adhering to the intermediate transfer body 10 is removed by the cleaning blade 11 even if the image forming sections 13-16 are operated to form images at the same time. Thus, it is possible to prevent that the toner of the image forming sections 13-15 adheres to the photoconductive drum 16*b* of the image forming section 16 via the intermediate transfer body 10.

In accordance with the fourth embodiment, the image forming section 16 is positioned at the most upstream side of the plurality of image forming sections arranged along the rotation direction intermediate transfer body 10. Thus, all the toner adhering to the intermediate transfer body 10 is removed by the cleaning blade 11. Thus, it is possible to prevent that the toner of the image forming sections 13-15 adheres to the photoconductive drum 16*b* of the image forming section 16 via the intermediate transfer body 10. Thus, the toner can be reused efficiently even if other image forming sections 13-15 are operated together with the image forming section 16 to form images.

In the image forming apparatus 4 according to the fourth embodiment described above, the number of the image forming sections is four, however, the present invention is not limited to this. The number of the image forming sections may be more or less than four.

In accordance with at least one embodiment described above, the image forming apparatus has a function of removing and collecting the toner left on the image carrier (photoconductive drum) after the image formed with the toner is transferred to the image formed medium and a function of controlling the relative position of the image forming section and the transfer section. With these functions, the image forming apparatus can reuse the toner efficiently.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus comprising:

a plurality of image forming sections configured to form an image on an image carrier with toner;

a transfer section configured to transfer each of the images formed on each of the image carriers to an image formed medium; and a control section configured to control the relative position of the image forming section and the transfer section; wherein the plurality of image forming sections include a cleaner section for removing the toner left on the image carrier after the image is transferred to the image formed medium, at least one of the plurality of image forming sections is provided with a toner recycling section for collecting the toner removed by the cleaner section and reusing the collected toner in the image formation again, and the control section separates the image forming section provided with the toner recycling section from the transfer position of the transfer section in a case in which the image forming section provided with no toner recycling section is forming an image.

2. The image forming apparatus according to claim 1, wherein transfer section includes an intermediate transfer body to which the image is primarily transferred and a secondary transfer body for secondarily transferring the image from the intermediate transfer body to the image formed medium, and the control section contacts only the image forming section provided with the toner recycling section with the intermediate transfer body in a case in which the image forming section provided with the toner recycling section is forming an image.

3. The image forming apparatus according to claim 1, further comprising:

a first driving section configured to change the position of the image forming section provided with the toner recycling section; wherein the control section drives the first driving section to change the position of the image forming section provided with the toner recycling section.

4. The image forming apparatus according to claim 2, further comprising:

a second driving section configured to change the position of the intermediate transfer body; wherein the control section drives the second driving section to change the position of the intermediate transfer body to separate the intermediate transfer body from the image forming section provided with the toner recycling section.

5. The image forming apparatus according to claim 1, wherein the plurality of image forming sections are arranged along the moving direction of the image formed medium.

6. The image forming apparatus according to claim 1, wherein the toner recycling section feeds the toner removed by the cleaner section to a developing device of the image forming section provided with the toner recycling section.

7. The image forming apparatus according to claim 2, wherein the plurality of image forming sections are arranged side by side along the intermediate transfer body.

8. The image forming apparatus according to claim 2, wherein the plurality of image forming sections are arranged side by side along the intermediate transfer body, and the image forming section provided with the toner recycling section is arranged at the most upstream side in the rotation direction of the intermediate transfer body within the plurality of image forming sections arranged along the rotation direction of the intermediate transfer body.

9. The image forming apparatus according to claim 1, wherein the image forming section provided with the toner recycling section forms an image with decolorable toner or decorative toner.

10. An image forming method of the image forming apparatus according to claim 1, including:

separating the image forming section provided with the toner recycling section from the transfer position of the transfer section in a case in which the image forming section provided with no toner recycling section is forming an image.

* * * * *